US007824015B2

(12) United States Patent
Pauly

(10) Patent No.: US 7,824,015 B2
(45) Date of Patent: Nov. 2, 2010

(54) INK JET WRITING HEAD

(75) Inventor: Manfred Pauly, Mühltal (DE)

(73) Assignee: REA Elektronik GmbH, Waschenbach (DE)

( * ) Notice: Subject to any disclaimer, the term of this patent is extended or adjusted under 35 U.S.C. 154(b) by 860 days.

(21) Appl. No.: 11/577,803

(22) PCT Filed: Oct. 24, 2005

(86) PCT No.: PCT/EP2005/011392

§ 371 (c)(1),
(2), (4) Date: Apr. 24, 2007

(87) PCT Pub. No.: WO2006/045572

PCT Pub. Date: May 4, 2006

(65) Prior Publication Data

US 2009/0115816 A1 May 7, 2009

(30) Foreign Application Priority Data

| | | |
|---|---|---|
| Oct. 25, 2004 | (DE) | 10 2004 051 973 |
| Jan. 26, 2005 | (DE) | 10 2005 003 541 |
| Apr. 5, 2005 | (DE) | 10 2005 015 694 |
| Apr. 28, 2005 | (DE) | 10 2005 020 248 |
| Jul. 2, 2005 | (DE) | 10 2005 031 034 |

(51) Int. Cl.
*B41J 2/04* (2006.01)

(52) U.S. Cl. ..... 347/54; 347/68

(58) Field of Classification Search ..... 347/54, 347/68, 70–72, 44, 47
See application file for complete search history.

(56) References Cited

U.S. PATENT DOCUMENTS 3,322,142 A * 5/1967 Baumann ..... 137/334

(Continued)

FOREIGN PATENT DOCUMENTS

DE 19528809 A1 2/1997

(Continued)

OTHER PUBLICATIONS

International Search Report for corresponding International Application PCT/EP2005/011392.
International Report on Patentability for corresponding International Application PCT/EP2005/011392.

*Primary Examiner*—Juanita D Stephens
(74) *Attorney, Agent, or Firm*—WRB-IP LLP

(57) ABSTRACT

An ink jet writing head includes a pressurized ink chamber provide with at least one ink nozzle that is closed by a mobile valve body. A piezoelectric valve actuating device that is electrically connected to a control device drives the valve body with reciprocating motions. The valve body is held by a closing spring in the closing position thereof and is connected to a connecting rod in a driving manner. At least one curved spring strip engages with the end of the connecting rod, located at a distance from the valve, the spring strip being supported on the valve-side end thereof, opposite the ink chamber. The connecting rod is subjected to the tractional prestress of a tension spring. At least one piezoelctric element is applied to the spring strip, the piezoelectric element being controlled by the control device in such a way as to perform tractile movements.

29 Claims, 7 Drawing Sheets

U.S. PATENT DOCUMENTS

| | | | | | |
|---|---|---|---|---|---|
| 4,576,111 | A | * | 3/1986 | Slomianny | 347/54 |
| 4,875,058 | A | * | 10/1989 | Vonasek | 347/54 |
| 5,602,575 | A | * | 2/1997 | Pauly | 347/54 |

FOREIGN PATENT DOCUMENTS

| | | | |
|---|---|---|---|
| JP | 01-018643 | A | 1/1989 |
| JP | 01018643 | | 1/1989 |
| WO | 94/08794 | A | 4/1994 |
| WO | 98/56585 | A | 12/1998 |

* cited by examiner

INK JET WRITING HEAD

BACKGROUND AND SUMMARY

The invention relates to an ink jet writing head comprising a pressurized ink chamber provided with at least one ink nozzle that is closed by a mobile valve body and a piezoelectric valve actuating device that is electrically connected to a control device and drives the valve body with reciprocating motions.

Such ink jet writing heads are used to print letters and numbers on surfaces that move past. Usually an ink chamber accommodates a plurality of ink nozzles that the control actuates selectively to briefly open the respective actuated nozzle. Due to the pressure in the ink chamber a brief ink jet is pushed out of the ink nozzle and creates a point on the print surface.

In a customary ink jet writing head (EP 0 445 137) the valve actuating elements are hinged magnets whose anchors are connected to the respective valve body in a driving manner. Here, the mass substantially formed by the anchor of the hinged magnet must be accelerated and decelerated with each valve actuating process.

The energy required for this process limits the possible working speed of the valve actuating device.

In a known ink jet writing head as described in the introduction (DE 1 952 880 A) it is proposed to use piezoelectric valve actuating elements to increase the working speed. However, such ink jet writing heads do not meet the practical demands at higher writing speeds.

Therefore, it is desirable to provide an ink jet writing head that can be used trouble-free at speeds required for practical applications.

According to an aspect of the present invention, a valve body is held by a closing spring in the closing position thereof and is connected to a connecting rod in a driving manner, said connecting rod preferably extending from the ink chamber in a sealed and mobile manner, in that at least one curved spring strip engages with the connecting rod, the end of said spring strip being supported opposite the ink chamber, in that the connecting rod is subjected to the tractional pre-stress of a tension spring and in that at least one piezoelectric element is applied to the spring strip, said piezoelectric element being controlled by the control device in such a way as to perform expansion or contraction movements.

Preferably plane piezoelectric elements are used, with piezoelectric elements on foil basis being especially suitable.

It is also possible to use piezoelectric elements on the basis of fibers or strips, for example commercially available MFC piezoelectric elements (macro-fiber composite piezoelectric element) known from WO 01/33648 A1.

High-performance piezoelectric elements in the form of plane piezoelectric elements are available, however due to their design, they are not readily useable to actuate valves on ink jet writing heads. However, the connection with a least one curved spring strip on which a plane piezoelectric element is applied on one side provides a valve actuating device that provides sufficient performance and working speed with very limited space requirements and thus can be used together with an ink jet writing head. Above all, operability of the valve actuating device is preserved even with high use frequency over long periods of time.

Preferably a pre-stressed piezoelectric element is applied to the inside of the curve of the spring strip that is energized to perform tractile movements only. It is also possible to apply a piezoelectric element on the outside of the curve of the spring strip that can be energized to perform contraction movements. It is especially advantageous to apply piezoelectric elements on both sides of the spring strip. This results in an especially high actuating force.

According to a preferred embodiment of the invention, only one curved spring strip to which one piezoelectric element is applied engages with the end of the connecting rod that is located at a distance from the valve. This means the masses that are to be moved are relatively small so that it is possible to achieve a high actual frequency.

Here it is advantageous to guide the end of the spring strip or the connecting rod that is located at a distance from the valve in a mobile manner in longitudinal direction of the connecting rod.

It also is possible to have an embodiment, wherein two spring strips curved in opposite direction engage with the end of the connecting rod located at a distance from the valve, said spring strip being supported on the valve-side end thereof, opposite the ink chamber, and wherein the piezoelectric elements of the two spring strips can be actuated together by means of the control device in such a way as to perform the movements. This symmetric design ensures a symmetric application of force on the connecting rod without the presence of a guide device.

With its end located at a distance from the valve, the connecting rod can extend through a bore of an upper tensioning block and can comprise an adjusting nut on one thread section that allows adjusting the pre-stress. On the valve side, the connecting rod extends through a bore of a lower tensioning block in which the end of the spring strip or the ends of the two spring strips, respectively, is/are accommodated.

According to a first embodiment of the invention the connecting rod is connected directly to the valve body. This results in a direct force translation from the connecting rod to the valve body. This embodiment is especially suitable if there is only one single ink nozzle or if there is sufficient distance between a plurality of ink nozzles. It also is possible for the connecting rod to be connected in a driving manner via an actuating lever with a valve connecting rod that is connected to the valve closing body. This embodiment allows for a staggered arrangement of the valve actuating devices on both sides of the ink chamber so that it is possible to reach ink nozzles that are arranged in relatively close proximity to one another.

BRIEF DESCRIPTION OF THE DRAWINGS

The invention is described in more detail based on exemplary embodiments that are shown in the drawing.

The following is shown:

FIG. 91 [sic] shows the vertical section of an arrangement of two adjacent valve actuating devices.

DETAILED DESCRIPTION

Figure 1:
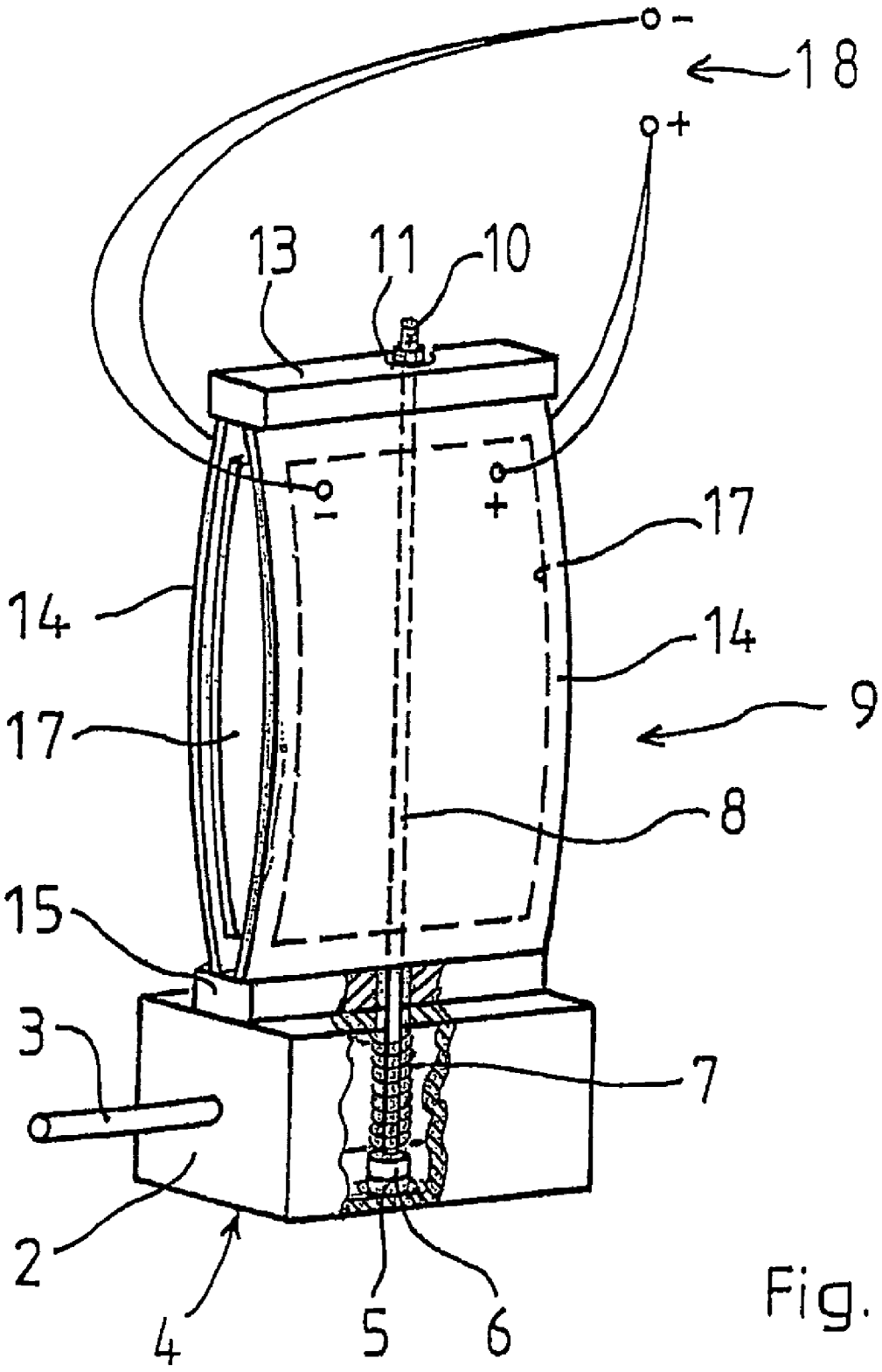
FIG. 1 shows a schematic, three-dimensional view of an ink jet writing head with an ink nozzle and a valve actuating device.
Figure 2:
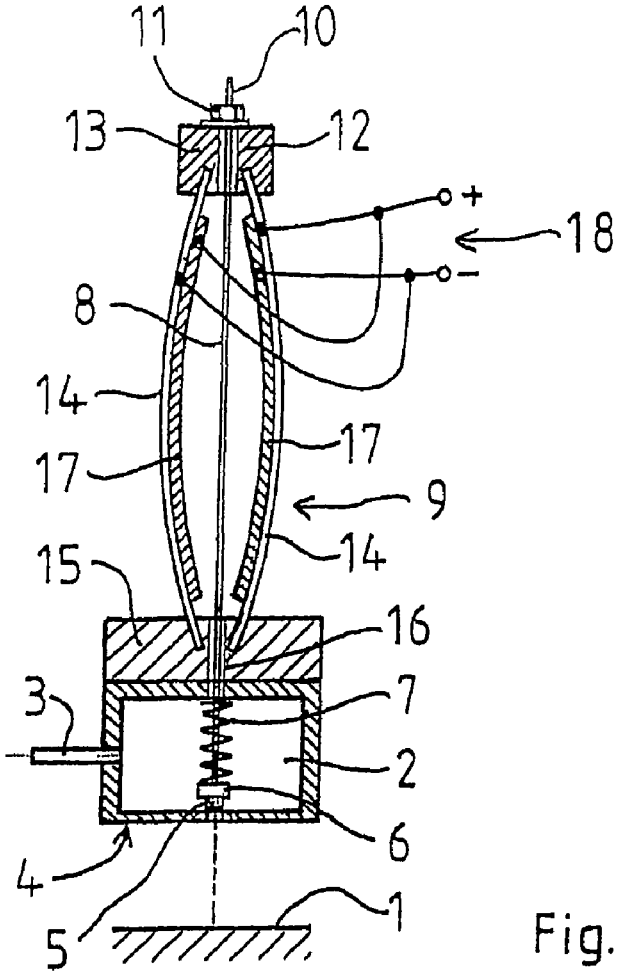
FIG. 2 shows a view in direction of arrow II in FIG. 1, partially a section along line II-II.

The ink jet writing head shown in FIGS. 1 and 2 is used to print letters and numbers on a surface 1 indicated in FIG. 2 while this surface 1 moves along the ink jet writing head. To this end the ink jet writing head has a pressurized ink chamber 2 that is filled with ink and that is supplied with ink via an ink line 3. One or a plurality of ink nozzles 5 are arranged in the floor wall 4 of the ink chamber 2 while FIG. 1 only shows one of these ink nozzles 5.

Each ink nozzle 5 is closed by a valve body 6 that can be driven to controlled reciprocating motions. The valve body 6 that is pushed into the closed position of the valve by a closing spring 7 that is a pressure spring, is connected to a valve actuating device 9 via a connecting rod 8 that extends from the ink chamber 2. The connecting rod 8 can be comprised of wire, a thin pull cable or a stranded cord.

The connecting rod 8 extends through the valve actuating device 9 and on its upper end located at a distance from the valve has an adjusting nut 11 on a thread section 10. At its end located at a distance from the valve the connecting rod 8 extends through a bore 12 of an upper tensioning block 13. At the end of the connecting rod 8 that is located at a distance of the valve two spring strips 14 that are curved in opposite, convex direction, engage and can be comprised of spring steel, for example. The upper ends of the two spring strips 14 are arranged in the upper tensioning block 13.

The lower ends of the two spring strips 14 are arranged in a lower tensioning block 15. On the valve side the connecting rod 8 extends through a bore 16 of the lower tensioning block 15 that is arranged directly on the ink chamber 2 in the exemplary embodiment according to FIGS. 1 and 2. In the exemplary embodiment according to FIG. 3 the lower tensioning block 15 also is an fixed position in relation to the ink chamber 2.

In this manner the two curved spring strips 14 that engage with the end of the connecting rod 8 located at a distance from the valve are being supported on the valve-side opposite the ink chamber 2.

The connecting rod 8 is subjected to the pre-stress of a tension spring. In the exemplary embodiment according to FIGS. 1 and 2 the closing spring 7 that pushes on the valve body 6 simultaneously acts as the tension spring of the connecting rod 8.

A piezoelectric element 17 each is applied to the inside of the curve of the two curved spring strips 14. Said piezoelectric elements preferably are plane piezoelectric elements, with piezoelectric elements on foil basis being especially suitable. It also is possible to use piezoelectric elements on fiber or strip basis. Both piezoelectric elements 17 are being controlled by the control device 18 in such a way as to perform tractile movements. Due to the pre-stress of the valve actuating device 9 and due to the resulting curve of the spring elements 14 on the concave curve insides, said two piezoelectric elements 17 are under mechanical pre-stress. Said piezoelectric elements are being controlled electrically by the control device 18 in such a way as to perform tractile movements only.

Figure 3:
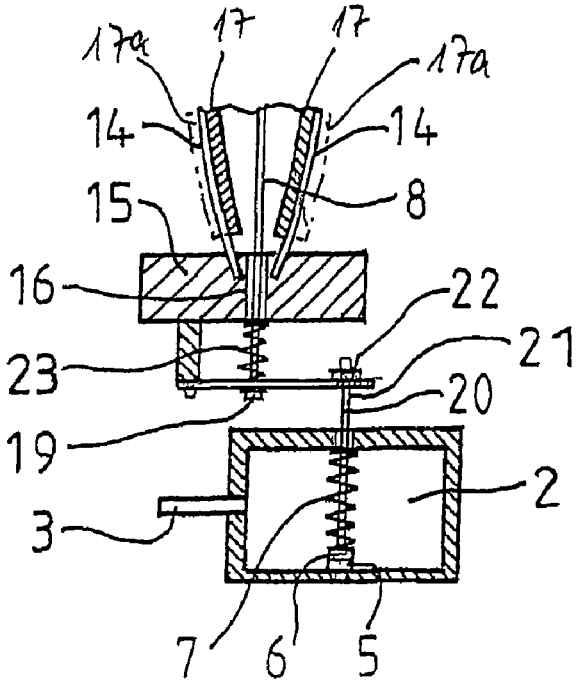
FIG. 3 shows a modified embodiment of an ink jet writing head in a partial section according to FIG. 2.

The dash-dotted lines in FIG. 3 simply indicate that in addition to the piezoelectric element 17 (or independent of it) an additional plane piezoelectric element 17*a* can be applied to the outside of the curve of the spring strip 14 that is wired in such a way as to perform contraction movements and thus exerts tensile forces.

In the exemplary embodiment according to FIGS. 1 and 2 the connecting rod 8 is connected directly to the valve body 6. In the exemplary embodiment according to FIG. 3, however, the connecting rod 8 is connected to a valve connecting rod 20 in a driving manner via an actuating lever 19 arranged on one side of the lower tensioning block 15, said valve connecting rod being connected to the valve closing spring 6. The valve connecting rod 20, which also extends from the ink chamber 2 in a sealed manner in this embodiment, has an adjusting nut 22 on an upper thread section 21, which allows for a longitudinal adjustment on the actuating lever 19.

A separate tension spring 23, in the form of a pressure spring, is arranged on the lower end of the connecting rod 8, said tension spring pushing the actuating lever 19 that is connected to the connecting rod 8 downward and in the process exerting the desired tension pre-stress on the connection rod 8. Thus a tension spring 23 engages with the connecting rod 8 that is separate from the closing spring 7.

Figure 4:
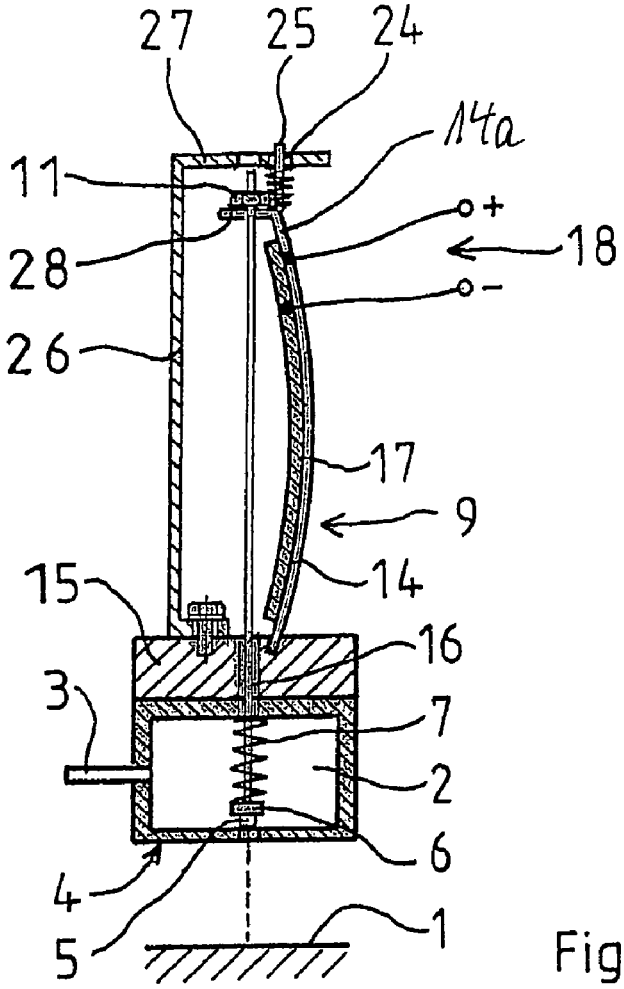
FIG. 4 shows a section of another modified embodiment of an ink jet writing head in a section according to FIG. 1.

The exemplary embodiment shown in FIG. 4 is different from the exemplary embodiment in FIG. 1 primarily in that instead of the two spring strips 14 on the end of the connecting rod located at a distance from the valve only one single curved spring strip 14 with one piezoelectric element 17 engages.

The end 14*a* of the spring strip 14 that is located at a distance from the valve is guided in a longitudinal guide in longitudinal direction of the connecting rod 8 and is moveable in a longitudinally mobile manner. For this purpose the longitudinal guide has a fixed guide slot 24 into which at least one upper longitudinal extension 25 of the spring strip 14 engages in a mobile manner. The guide slot 24 is arranged on a guide sheet 26 whose one end is fastened, for example screwed, to the tensioning block 15 and whose other end is angled off into a horizontal plate 27. The longitudinal extensions 24 [sic] of the spring steel 14 are formed by the lateral strips of the spring steel 14 that are elongated upward, i.e. in longitudinal direction of the connecting rod 8. A horizontally angled off loop 28 between these two longitudinal extensions 25 is arranged below the adjusting nut 11 and transmits the movements of the spring steel 14 to the connecting rod 8. Since the masses that must be moved in the process are relatively small, it is possible to reach very high actual frequencies.

The longitudinal guide can be such that the end of the connecting rod 8 located at a distance from the valve can be arranged in a mobile manner in the longitudinal guide in longitudinal direction of the connecting rod, for example also in a guide bore in the plate 27.

Figure 5:
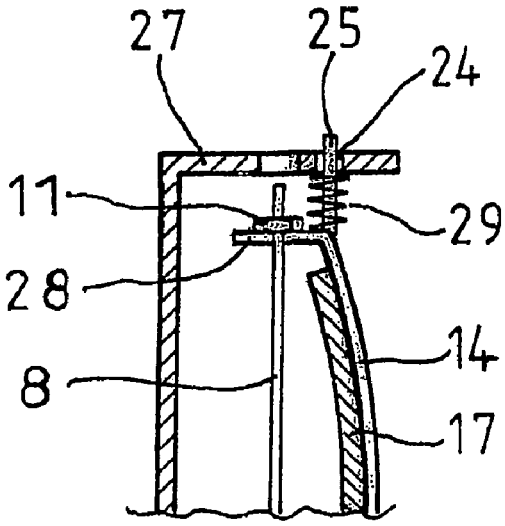
FIG. 5 shows a partial view of a modified embodiment according to FIG. 4.

In the exemplary embodiment of which a partial view is shown in FIG. 5, a spring 29 engages with the end 14*a* of the spring strip 14 located at a distance from the valve, said spring being a pressure spring in this case. Said spring 29 supports itself on the bottom of the plate 27 and pre-stresses the spring strip 14 in the direction of movement of the connecting rod 8. The required pre-stress of the piezoelectric element 17 substantially is due to the spring 29 so that on one hand the pre-stress of the piezoelectric element 17 can be precisely set and on the other hand the closing spring 7 can be weaker.

Figure 6:
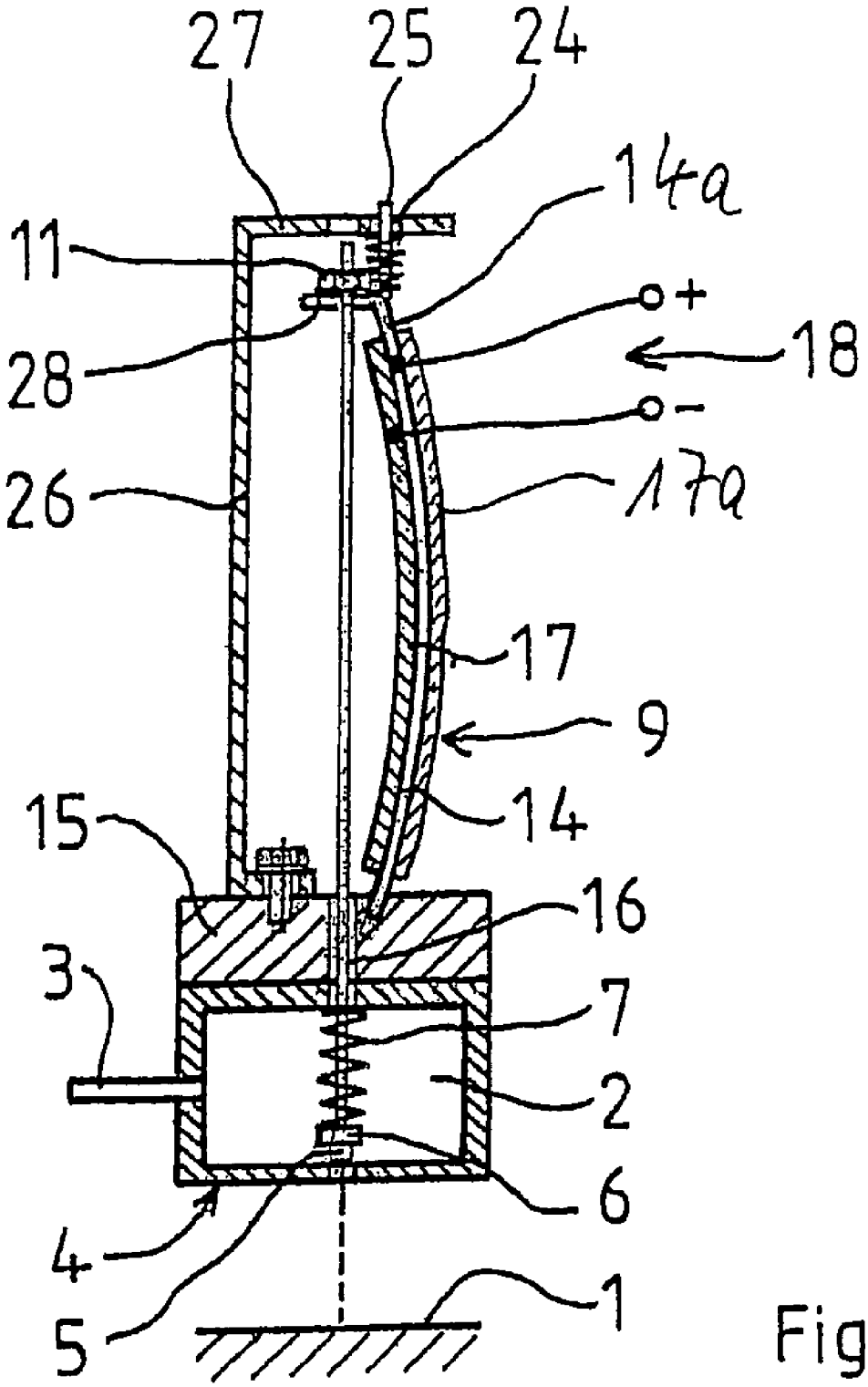
FIG. 6 shows another modified embodiment in a section according to FIG. 4.

FIG. 6 shows a valve actuating device that is similar to the one shown in FIG. 4 with a plane piezoelectric element 17*a* being applied to the outside of the curve of the spring strip 14 that [deleted "for"] can be controlled in such a way as to perform contraction movements in the manner already described in FIG. 3.

Figure 7:
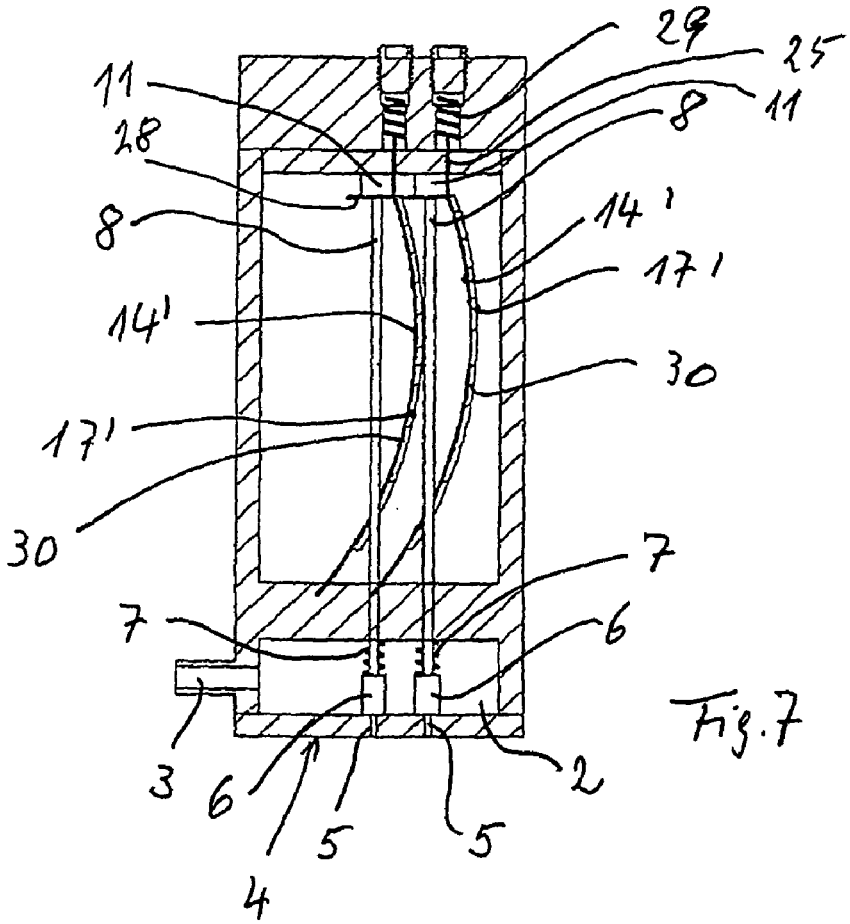
FIG. 7 shows a modified embodiment of an ink jet writing head in a section according to FIG. 2.

FIG. 7 shows a vertical section through two valve actuating devices that are arranged directly adjacent to each other in an ink jet writing head with each having a curved spring strip 14' and a connecting rod 8 that engages with the end of the spring strip 14' that is located at a distance from the valve. A plane piezoelectric element 17' is applied to the outside curve of the spring strip 14'.

The connection of the upper end of each spring strip 14' that is located at a distance from the valve is similar to that described according to FIG. 6. However, in this case the connecting rod 8 does not extend through a through opening 30 of the spring strip 14' and the plane piezoelectric element 17'. As FIG. 8 shows clearly, the through opening 30 for the connecting rod 8 is a longitudinal slot that is open up to the end of the spring strip 14' on the valve side.

Extending the connecting rod 8 through the through opening 30 of the spring strip 14' provides for a space-saving design. The distance between two adjacent connecting rods 8 and thus between two adjacent ink nozzles 5 can be quite narrow despite the relatively large angular point of the curved spring strip 14' because the support of the end of each spring strip 14' on the valve side—as shown in FIG. 7—can be in the vicinity of the respective adjacent connecting rod 8. Based on the distance between the ink nozzles 5 that is given for each individual use, it is possible to select a relatively strong curve of the spring strip 14' that is favorable for the effectiveness of the piezoelectric valve actuating device.

Figure 8:
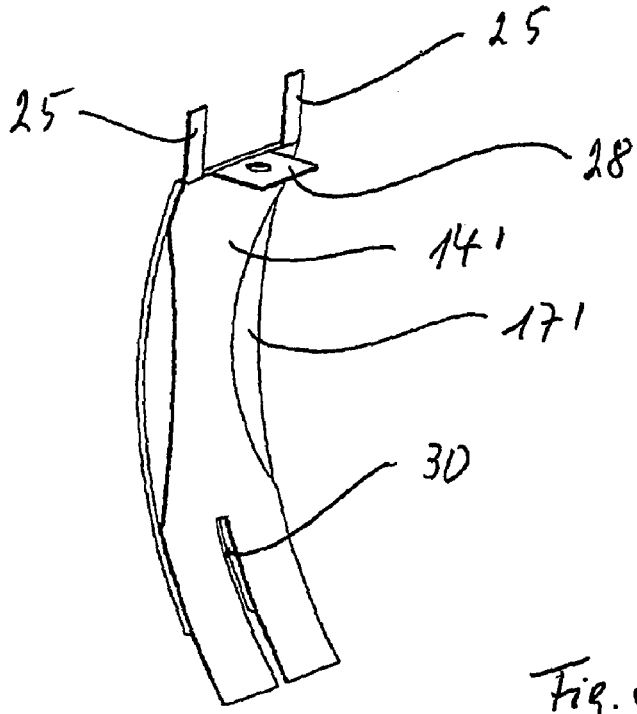
FIG. 8 shows another modified embodiment of an ink jet writing head in a section according to FIG. 2.

FIG. 8 furthermore shows that the mid-section of the spring strip 14' is laterally constricted. This provides for an increase in flectional elasticity in the mid-section of the spring strip 14'. This is favorable for the drive behavior.

Figure 9:
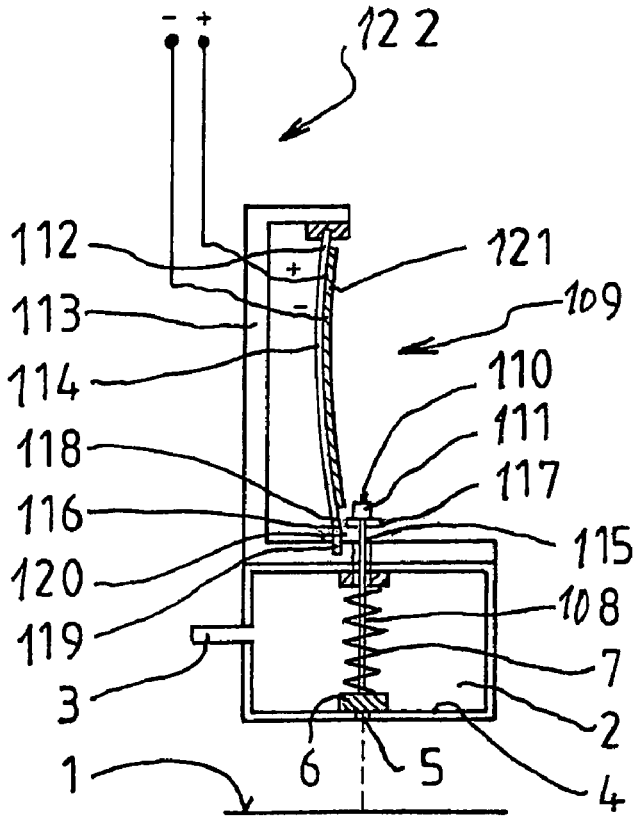

In the exemplary embodiment according to FIG. 9 a curved or bent spring strip 114 engages with the end of the connecting rod 108 that extends into the valve actuating device 109, said spring strip being comprised of spring steel, fiber-reinforced plastic or similar elastic material. At its (in the drawing upper) end 114*a* that is located at a distance from the valve, the curved spring strip 114 is fastened to a hanger shaped carrier 113 which can be fixed to the upper wall of the ink chamber 2. In the shown exemplary embodiment the connecting rod 108 extends through a bore 115 in the upper wall of the ink chamber 2 and through a bore 116 of a bent loop 117 on the end 118 of the spring strip 114 located near the valve.

A tongue 119 located at the end 118 of the spring strip 114 located near the valve that extends in the direction of movement of the connecting rod 8 is guided in a mobile manner in a recess 120 that serves as a longitudinal guide in longitudinal direction of the connecting rod 108.

In the exemplary embodiment shown in FIG. 9 the curved spring strip 114 has a piezoelectric element 121 on the inside of its curve. Said piezoelectric element preferably is a plane piezoelectric element with piezoelectric elements on foil basis being especially suitable. It also is possible to use piezoelectric elements on the basis of fibers or strips.

The piezoelectric element 121 is controlled by an electric control device 122, which is only indicated schematically in the drawing, in such a way as to perform contraction movements. When the electrically controlled piezoelectric element 121 contracts, the curve or curvature of the spring strip 114 is increased. This exerts a tensile force on the connecting rod 108; the valve is opened. The valve closes again due to the effect of the closing spring 7 as soon as the tensile force no longer acts.

Figure 10:
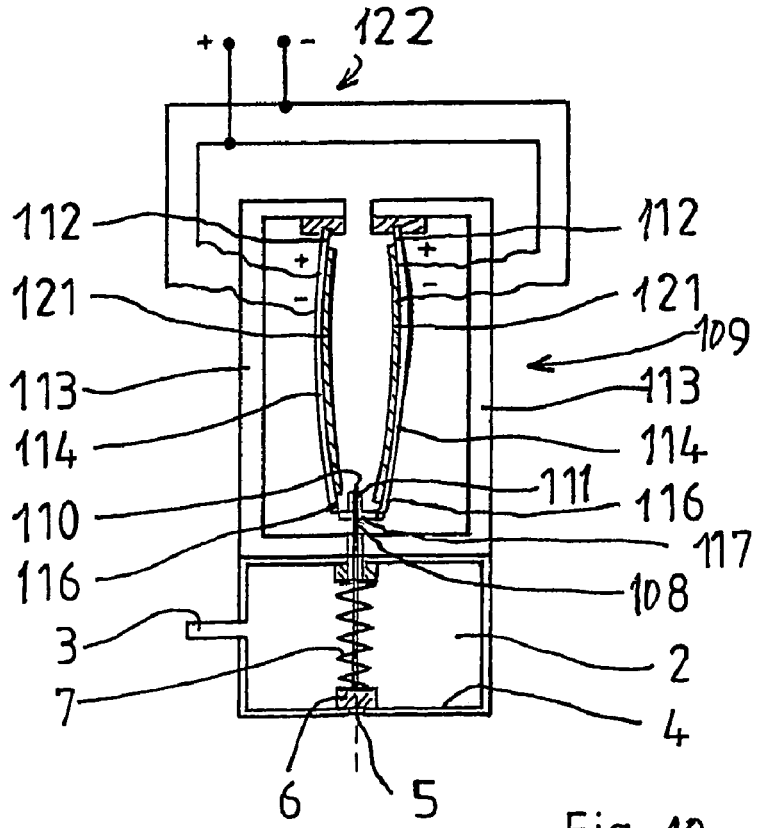
FIG. 10 shows a three-dimensional view of one of the two spring strips shown in FIG. 9, comprising a plane piezoelectric element.

The ink jet writing head shown in FIG. 10 is different from the writing head according to FIG. 7 in that two spring strips 114 curved in opposite direction engage with the connecting rod 108, said spring strips being arranged in a manner as described in the example according to FIG. 9. Both spring strips 114 are fastened at the ends 112 that are located at a distance from the valve and are connected to each other and to the connecting rod 108 at the ends located near the valve. A longitudinal guide, as described in FIG. 9, is not necessary in this double arrangement of the spring strips 114.

Figure 11:
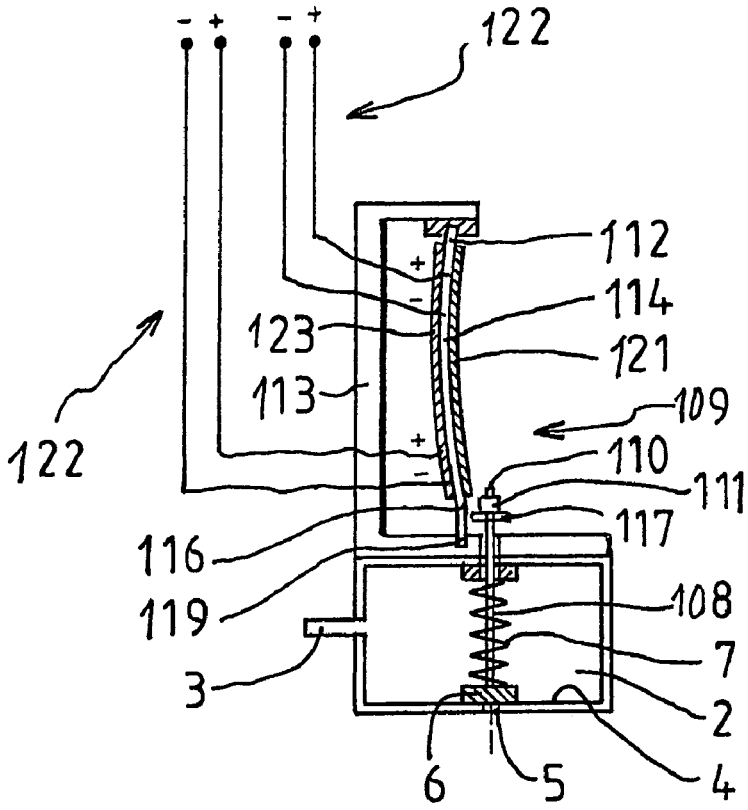
FIG. 11 shows a longitudinal section of an ink jet writing head with an ink jet and a valve actuating device that only has one curved spring strip.

The exemplary embodiment shown in FIG. 11 is different from the exemplary embodiment according to FIG. 1 in that in addition to the already described plane piezoelectric element 121 on the inside of the curve of the spring strip 114 an additional plane piezoelectric element 123 is applied to the outside of the curve of the spring strip 114. While the piezoelectric element 121 on the inside of the curve can be controlled in the described manner by means of the electric control device 122 in such a way as to perform contraction movements, the plane piezoelectric element 123 on the outside of the curve 114 is such that it can be controlled by the electric control device 122 so as to perform expansion movements. The contraction of the piezoelectric element 121 on the inside of the curve and the tractile movement of the piezoelectric element 123 on the outside of the curve of the spring strip 114 cause the curve or curvature of the spring strip 114 to increase and thus exert a tensile force on the connecting rod 108.

Figure 12:
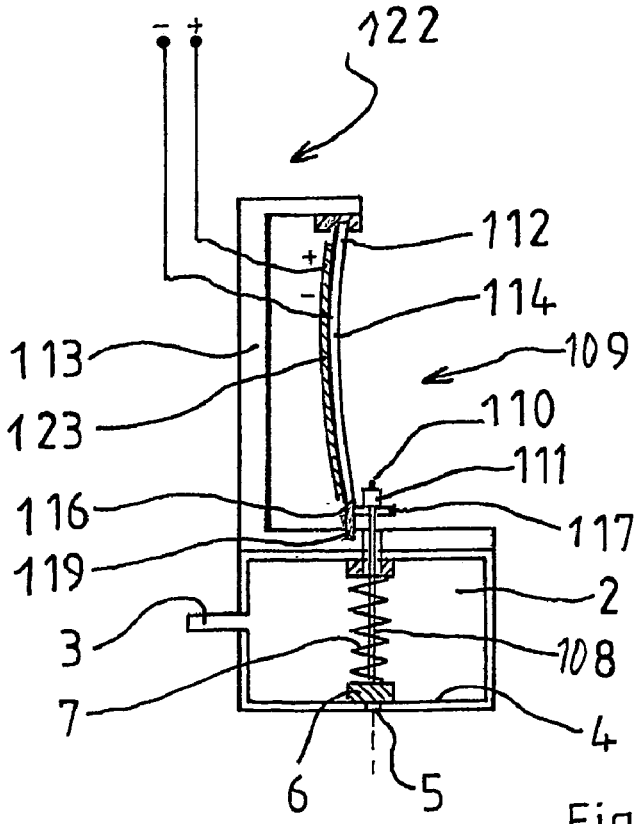
FIG. 12 shows an ink jet writing head with an ink nozzle and a valve actuating device with two curved spring strips in a section according to FIG. 7.

The exemplary embodiment according to FIG. 12 is different from the embodiment in FIG. 11 only in that here there is no piezoelectric element on the inside of the curve of the spring strip 114 so that the spring strip 114 only carries the piezoelectric element 123 on the outside of the curve that is used for expansion movements.

The invention claimed is:

1. Ink jet writing head comprising a pressurized ink chamber provided with at least one ink nozzle that is closed by a mobile valve body and a piezoelectric valve actuating device that is electrically connected to a control device and drives the valve body with reciprocating motions, wherein the valve body is held by a closing spring in the closing position thereof and is connected to a connecting rod in a driving manner, at least one curved spring strip engages with the end of the connecting rod, the end of said spring being supported opposite the ink chamber, the connecting rod is subjected to the tractional pre-stress of a tension spring and at least one piezoelectric element is applied to the spring strip, said piezoelectric element being controlled by the control device in such a way as to perform expansion or contraction movements.

2. Ink jet writing head according to claim 1, wherein the curved spring strip engages with the end of the connecting rod, located at a distance from the valve, said spring being supported on the valve-side end thereof, opposite the ink chamber.

3. Ink jet writing head according to claim 2, wherein only one curved spring strip with one piezoelectric element engages with the end of the connecting rod located at a distance from the valve.

4. Ink jet writing head according to claim 3, wherein the end of the spring strip located at a distance from the valve is guided in a longitudinal guide in longitudinal direction of the connecting rod.

5. Ink jet writing head according to claim 4, wherein the longitudinal guide has a fixed guide slot in which an upper longitudinal extension of the spring strip engages in a mobile manner.

6. Ink jet writing head according to claim 2, wherein two spring strips curved in opposite direction engage with the end of the connecting rod located at a distance from the valve, said spring strips being supported on the valve-side end thereof, opposite the ink chamber and the piezoelectric elements of the two spring strips can be controlled together by means of the control device as to perform tractile movements.

7. Ink jet writing head according to claim 6, wherein the two spring strips are curved in opposite, convex direction.

8. Ink jet writing head according to claim 2, wherein only one curved spring strip to which a piezoelectric element is applied on one or on both sides, engages with the end of the connecting rod.

9. Ink jet writing head according to claim 2, wherein the connecting rod, on the valve-side, extends through a bore of a lower tensioning block (15) and the end of the spring strip or the ends of the two spring strips is/are arranged in the lower tensioning block (15).

10. Ink jet writing head according to claim 2, wherein the connecting rod extends through a through opening in the valve-side half of the spring strip and the piezoelectric element applied to it.

11. Ink jet writing head according to claim 10, wherein the through opening for the connecting rod is a longitudinal slot that is open towards the valve-side end of the spring strip.

12. Ink jet writing head according to claim 1, wherein the curved spring strip is fastened on its end located at a distance from the valve and the at least one piezoelectric element applied to the spring strip can be controlled by the control device to perform length changes that increase the curve of the spring strip so that a tractile force is exerted on the connecting rod.

13. Ink jet writing head according to claim 12, wherein the piezoelectric element is applied to the inside of the curve of the spring strip and can be controlled in such a way as to perform contraction movements.

14. Ink jet writing head according to claim 12, wherein the piezoelectric element is applied to the outside of the curve of the spring strip and can be controlled to perform expansion movements.

15. Ink jet writing head according to claim 12, wherein two spring strips curved in opposite direction engage with the connecting rod said spring strips being fastened at the end located at a distance from the valve and the piezoelectric elements of the two spring strips can be controlled together by the control device in such a way as to perform length changes.

16. Ink jet writing head according to claim 12, wherein only one spring strip is used and the end of the spring strip located close to the valve is guided in a mobile manner in a longitudinal guide in longitudinal direction of the connecting rod.

17. Ink jet writing head according to claim 1, wherein the piezoelectric element is a plane piezoelectric element.

18. Ink jet writing head according to claim 17, wherein the piezoelectric elements are made on the basis of foil.

19. Ink jet writing head according to claim 17, wherein the piezoelectric elements are made on the basis of fibers or strips.

20. Ink jet writing head according to claim 17, wherein the piezoelectric elements are MFC piezoelectric elements.

21. Ink jet writing head according to claim 1, wherein the piezoelectric element is applied to the inside of the curve of the spring strip.

22. Ink jet writing head according to claim 1, wherein the piezoelectric element is applied to the outside of the curve of the spring strip.

23. Ink jet writing head according to claim 1, wherein the piezoelectric elements are applied to both sides of the spring strip.

24. Ink jet writing head according to claim 1, wherein the connecting rod is connected directly to the valve body.

25. Ink jet writing head according to claim 1, wherein the connecting rod is connected in a driving manner via an actuating lever with a valve connecting rod that is connected to the valve closing body.

26. Ink jet writing head according to claim 1, wherein the closing spring of the valve body simultaneously provides the tension spring of the connecting rod.

27. Ink jet writing head according to claim 1, wherein the connecting rod engages with a separate tension spring that is separate from the closing spring.

28. Ink jet writing head according to claim 1, wherein the spring strip is pre-stressed in the direction of movement of the connecting rod by means of a spring that engages with the end of said spring strip located at a distance from the valve.

29. Ink jet writing head according to claim 1, wherein the spring strip is laterally constricted in its mid-section.

* * * * *